United States Patent [19]

Grier et al.

[11] Patent Number: 4,799,881

[45] Date of Patent: Jan. 24, 1989

[54] "TWIST-LOCK" GAS NOZZLE FOR A HEAT TREATING FURNACE

[75] Inventors: John K. Grier, Walnut; Dane T. McGuire, San Dimas, both of Calif.

[73] Assignee: Grier-McGuire Inc., Industry, Calif.

[21] Appl. No.: 82,045

[22] Filed: Aug. 5, 1987

Related U.S. Application Data

[63] Continuation-in-part of Ser. No. 919,769, Oct. 16, 1986, abandoned.

[51] Int. Cl.[4] ..... F27D 15/02

[52] U.S. Cl. ..... 432/77; 239/600

[58] Field of Search ..... 432/121, 77; 239/600, 239/391, 397; 285/396, 402

[56] References Cited

U.S. PATENT DOCUMENTS

| | | | |
|---|---|---|---|
| 3,799,453 | 3/1974 | Hart | 285/396 X |
| 4,395,832 | 8/1983 | Jones et al. | 34/233 |
| 4,560,348 | 12/1985 | Moller et al. | 239/600 X |

FOREIGN PATENT DOCUMENTS

| | | | |
|---|---|---|---|
| 1487141 | 6/1967 | France | 239/600 |

*Primary Examiner*—Edward G. Favors

*Attorney, Agent, or Firm*—Christie, Parker & Hale

[57] ABSTRACT

A re-usable and interchangeable nozzle for delivering cooling gas into the work chamber of a heat treating furnace, provided in the form of any of various keyed tube and mounting base combinations which allows assembly from within the furnace by an axial movement followed by a rotary motion. The preferred embodiment consists of a cylindrical tube made of any suitable material (including but not limited to molybdenum, graphite, or ceramic) having a keyed slot in its lower end and a matching base made of any suitable material which has a mating pin in it. The base is firmly fixed in place by welding or any suitable means and the tube can be removed from the base without damage by first rotating it then pulling it along its axis.

10 Claims, 2 Drawing Sheets

"TWIST-LOCK" GAS NOZZLE FOR A HEAT TREATING FURNACE

CROSS-REFERENCE TO RELATED APPLICATIONS

This application is a continuation-in-part of U.S. Ser. No. 919,769 filed Oct. 16, 1986, abandoned, the subject matter of which is hereby incorporated by reference.

BACKGROUND OF THE INVENTION

This invention relates generally to a gas nozzle for a heat treating furnace, and more particularly, for a heat treating furnace of the type in which a cooling gas flows from a gas directing construction or plenum into the work chamber through a large number of nozzles after the workpieces have been heated. One example of this general type of heat treating furnaces can be found in Jones, et al., U.S. Pat. No. 4,395,832.

In the above mentioned U.S. Pat. No. 4,395,832, each nozzle is externally threaded inserted through the wall of the gas directing device or plenum, and held in place by a lock nut on each side of that wall. This limits the materials used to those suitable for threading and limits the furnace design to those which provide easy access to both sides of the nozzle attachment point on the plenum.

In Moller and Wolter U.S. Pat. No. 4,560,348, the resilience of the nozzle material is relied upon for insertion or removal, a special tool is used to compress it for insertion or removal, and a flare at one end or another provides retention. The fact that it must be compressed for insertion or removal limits the materials suitable for its construction to those which are resilient, such as molybdenum. However, because molybdenum becomes extremely brittle and non-resilient once heated to normal working temperatures for this type of furnace, the very act of attempting to compress a molybdenum or similar nozzle after initial use could shatter it, making it totally unfit for re-use. This is especially true with the flared nozzle design of U.S. Pat. No. 4,560,348, which would require the nozzle to be compressed to about one-half its expanded diameter for removal. Also, it is very difficult to draw molybdenum to form a flare.

SUMMARY OF THE INVENTION

The general aim of the present invention is to provide a new and improved self-retaining gas nozzle for a heat treating furnace, the nozzle being particularly characterized by the useful wide range of materials suitable for its construction, the ability to be easily inserted from within the furnace without special tools or disassembly, and the ability to be removed from a furnace after initial use without probable damage.

A more detailed object of the invention is to achieve the foregoing by providing a unique nozzle in the form of any of various keyed tube and mounting base combinations which allow assembly from within the furnace by an axial movement followed by a rotary motion. The base can have a locking lug of any sort and the tube a mating slot or groove, or vice versa. The tube can fit outside the base as shown, or inside the bore of the base. Various such designs or configurations will suffice, but especially the illustrated example, the preferred embodiment. The preferred embodiment consists of a cylindrical tube made of any suitable material (including molybdenum, graphite, and ceramics) having a keyed slot in its lower end and a matching base made of any suitable material which has a mating pin in it. The base is firmly fixed in place by welding or any suitable means and the tube can be removed from the base without damage by first rotating it then pulling it along its axis.

In an alternate preferred embodiment, the cylindrical tube is constructed from a rectangular sheet of any suitable resilient material (including molybdenum) that is rolled up upon itself. The rectangular sheet has at least two keyed slots along its lower edge that can overlap when the sheet is rolled up upon itself and held in place, and receive a mating pin on a mounting base. When a tube constructed from the sheet is attached to the mounting base and then released, the sheet tends to try to unroll. This unrolling action eliminates the overlap in the keyed slots and locks the mating pin in place. The tube can be removed from the base without damage by compressing the tube slightly to regain the overlap in the keyed slots and then by first rotating it then pulling it along its axis.

These and other objects and advantages of the invention will become more apparent from the following detailed description when taken in conjunction with the accompanying drawing.

DETAILED DESCRIPTION OF THE PREFERRED EMBODIMENT

Figure 1:
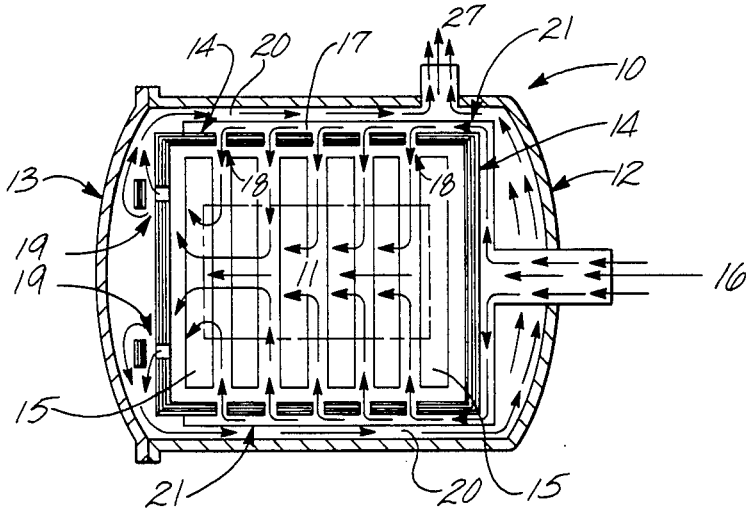
FIG. 1 is a schematic cross-sectional view taken longitudinally through a typical heat treating furnace equipped with new and improved gas nozzles incorporating the unique features of the present invention.

For purposes of illustration, the invention is shown in the drawings in conjunction with a vacuum furnace 10 for heat treating workpieces (not shown) in a chamber 11 (FIG. 1). In general, the furnace comprises an outer shell 12 formed with a circular cross-section and closed at one end by a releasable door 13. The heating chamber 11 is defined within a walled and otherwise insulated enclosure 14 disposed inside of the shell and spaced inwardly from the walls thereof. Several electric resistance heating elements 15 are located within the internal enclosure 14.

After the workpieces have been heated, a cooled and inert gas such as argon on nitrogen is introduced into the chamber as at 16 in order to quench the workpieces.

As shown schematically in FIG. 1 by the arrows, the gas is directed into the space 17 between the shell 12 and the enclosure 14 and flows into the hot chamber through tubular nozzles 18 located in the wall of the enclosure 14. The now heated gas discharged out of the chamber 11 flows through holes 19 in the enclosure 14 and within a plenum 20 defined between the shell 12 and a jacket 21 which encircles the enclosure, until it reaches a discharge point 27.

Figure 2:
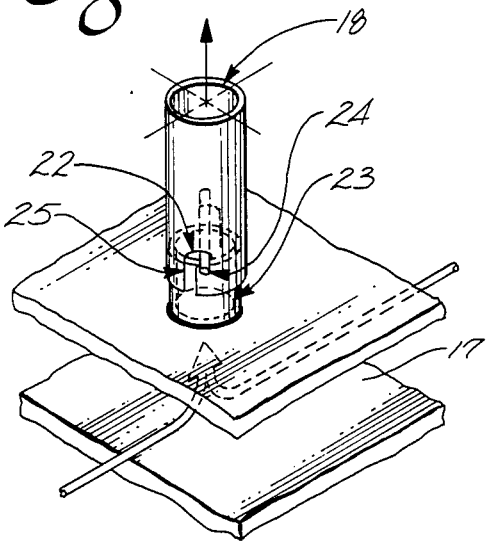
FIG. 2 is an enlarged perspective view showing one of the nozzle assemblies mounted in the wall of the internal enclosure, with the usual insulation 26 removed for clarity.
Figure 3:
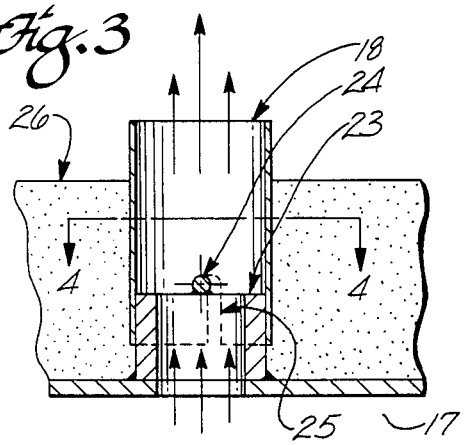
FIG. 3 is a cross-sectional view of the nozzle assembly shown in FIG. 2. Note that the insulation 26 can be of any type or construction, including radiation shields.
Figure 4:
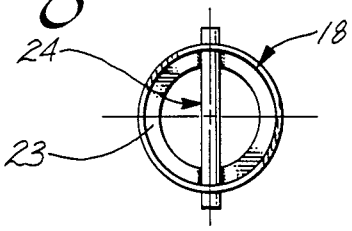
FIG. 4 is a cross-sectional view of the nozzle assembly shown in FIG. 3 taken along the line 4—4 of FIG. 3.
Figure 5:
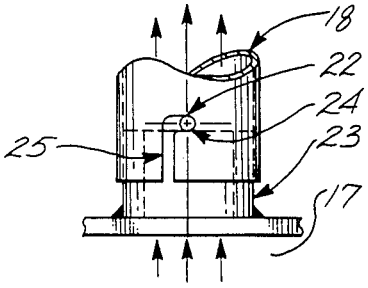
FIG. 5 is an enlarged view of the lower portion of FIG. 3 as it would appear if not a section.

In order to introduce the cooling gas into the chamber 11 at several locations, the furnace 10 is equipped with a large number of nozzles 18 which are located at spaced locations around the chamber, the present furnace including over one hundred nozzles. In accordance with the present invention, each of the nozzles 18 is made of a high temperature material formed into a cylindrical tube with 2 right-angle slots 22 cut into its lower edge 180° apart (FIG. 2). Each nozzle is locked onto its base 23 by the engagement of its slot 22 with the pin 24 welded to base 23. A simple twist of the nozzle 18 will align the pin 24 with the vertical leg 25 of slot 22, allowing a vertical pull to disengage the nozzle 18 from its base with no probably damage. Assembly is accomplished by the reverse procedure: slide nozzle 18 onto base 23 and rotate until pin 24 no longer aligns with the vertical leg 25 of slot 22.

From the foregoing, it will be apparent that the present invention brings to the art a new and improved self-retaining nozzle assembly 18 and 23 which allows nozzle 18 to quickly and easily be installed from inside the furnace 10 and as quickly and easily removed from the furnace later and re-used, all without special tools, flares, threads, nuts, free pins, wires, or other removable retaining elements. This new and improved self-retaining nozzle has the further advantage of being able to be made of various different materials such as but not limited to molybdenum, ceramics and graphite, each having different benefits to the industry. Thus a furnace could have several different sets of nozzles of varying composition throughout its useful life span without major re-work.

Figure 6:
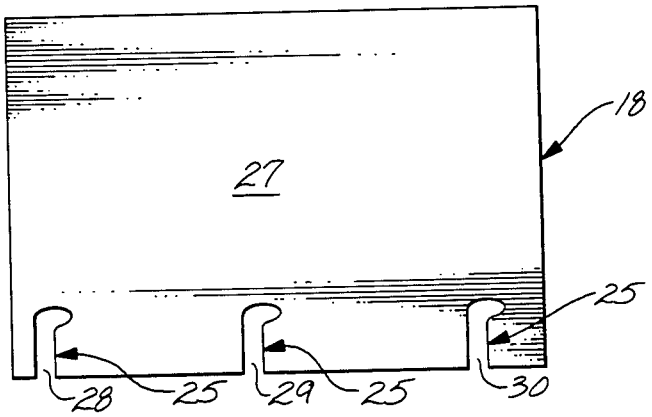
FIG. 6 is a side view of an alternate tube construction with a sheet forming the cylindrical tube rolled out flat.

With reference to FIG. 6, an alternate construction for the cylindrical tube of nozzle 18 is shown. In this alternate embodiment, the cylindrical tube is constructed from a rectangular sheet 27 of any suitable resilient material (including molybdenum) that is rolled up upon itself. As shown in FIG. 6, sheet 27 is rolled out flat. Three right-angle slots 28, 29 and 30 are cut into the edge of sheet 27 that will form the lower edge of nozzle 18. When the sheet is rolled up upon itself, the two end slots 28 and 30 can overlap with one another to form, in effect, a single right-angle slot. The center slot 29 will be spaced roughly 180° apart from the overlapped slots when the sheet is rolled up upon itself.

Figure 7:
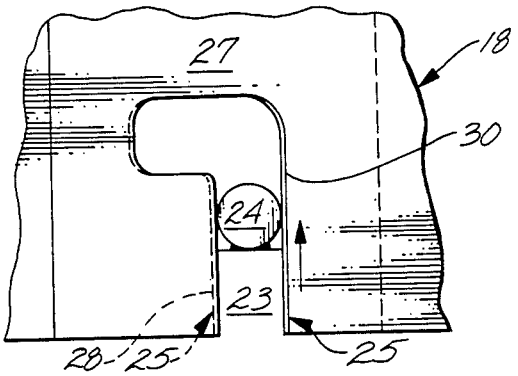
FIG. 7 is an enlarged side view of a keyed slot in a tube constructed using the sheet of FIG. 6 during axial movement.

When sheet 27 is rolled up upon itself, it can be held in place by hand or other suitable means so that slots 28 and 30 overlap one another (FIG. 7). In this position, nozzle 18 is assembled with base 23 in the same way as the previously-described embodiment. The nozzle can slide onto base 23 as pin 24 slides along the vertical legs 25 of slot 29 and the overlapped slots 28 and 30. Then the nozzle is rotated until the pin no longer aligns with the vertical legs of the slots.

Figure 7A:
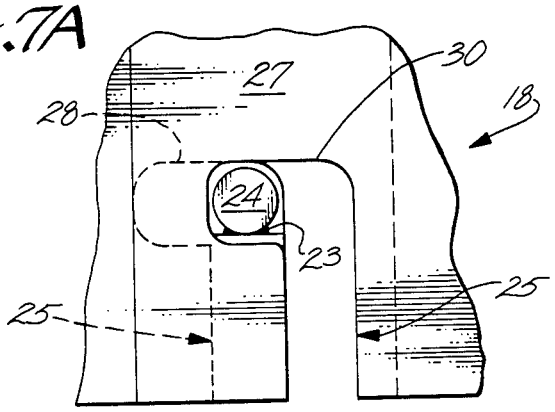
FIG. 7A is an enlarged side view of the keyed slot of FIG. 7 after the axial movement followed by rotary motion used to attach the tube to the mounting base has been completed.

After the nozzle has been rotated until the pin no longer aligns with the vertical legs of the slots, the nozzle is released so that it is no longer held in place with slots 28 and 30 overlapping. When the nozzle is released, sheet 27 tends to try to unroll and assume its flat position. This unrolling action eliminates the overlap in the right-angle slots (FIG. 7A). However, pin 24 prevents the sheet from unrolling completely because it extends through slots 28 and 30.

The elimination of the overlap in the right-angle slots caused by the unrolling action has the effect of locking pin 24 in place. The locking is caused by slot 28 sliding over to hold pin 24 in slot 30 at a position where it is not aligned with the vertical leg of slot 30 (FIG. 7A). Thus, although this alternate embodiment can be practiced only with nozzles made of a suitable resilient material, it has the added advantage of providing a mechanism for quickly and easily locking the nozzles on their bases.

The nozzle can be removed from the base by compressing the tube slightly to regain the overlap in slots 28 and 30 and then by twisting it until pin 24 aligns with the vertical legs of the slots and pulling it away from the base. Compressing the nozzle to remove it will not damage the nozzle, even if it is made of molybdenum and has been heated to normal working temperatures, because the compression required is very slight. The ends of the sheet need only be pushed together the width of pin 24.

We claim:

1. A heat treating furnace comprising:
   a shell;
   wall means disposed within said shell and defining a heating chamber inside of said shell;
   means for heating workpieces in said chamber, there being a space between said shell and said wall means, holes extending through said wall means, nozzles disposed in said holes and establishing communication between said space and said chamber;
   means for causing gas to flow from said space and said chamber through said nozzles; and
   means allowing an internal end of said nozzles to be inserted and removed from inside the furnace and removed after initial heat up without damaging the end so that it can be re-used.

2. A heat treating furnace as defined in claim 1 whose nozzles comprise an end able to be assembled with the remainder of the nozzle by a linear motion along its axis folowed by a rotating motion, and disassembled by the reverse action.

3. A heat treating furnace as defined in claim 2 whose nozzles are interlocked by a combination of keyed slots and lugs.

4. A heat treating furnace as defined in claim 2 whose nozzles are comprised of a cylindrical tube having a keyed slot in its lower end and a matching base which has a mating pin in it.

5. A nozzle for a heat treating furnace, comprising:
   a nozzle end;
   a matching base for the nozzle end attached to the furnace; and
   means for connecting the nozzle end to the matching base allowing the nozzle end to be inserted and removed from inside the furnace and removed after initial heat up of the furnace without damaging the nozzle end so that it can be re-used.

6. A nozzle according to claim 5 wherein the nozzle end can be connected with the base by a linear motion along its axis followed by a rotating motion and the nozzle end can be removed by the reverse action.

7. A nozzle according to claim 6 wherein the means for connecting is comprised of a combination of keyed slots and lugs.

8. A nozzle according to claim 6 wherein the nozzle end is comprised of a cylindrical tube and the means for connecting is comprised of a keyed slot in an end of the cylindrical tube and a mating pin attached to the matching base.

9. A nozzle for a heat treating furnace, comprising:

a sheet of resilient material having at least two keyed slots along an edge of the sheet that can be made to overlap one another when the sheet is rolled up upon itself and held in position; and a base attached to the furnace and having a pin attached to it capable of being received by the overlapping keyed slots in the sheet, the pin preventing the sheet from unrolling when it is no longer held in position but allowing the sheet to unroll enough to lock the pin in the keyed slots.

10. A nozzle according to claim 9 wherein a third keyed slot is provided along the edge of the sheet between the two keyed slots that can be made to overlap and the base has a second pin attached to it capable of being received by the third keyed slot.

* * * * *